United States Patent [19]

Weibull

[11] 3,934,355

[45] Jan. 27, 1976

[54] APPARATUS FOR STORING GRAINS AND OTHER VEGETABLE PRODUCTS

[75] Inventor: Claes Martin Weibull, Hassleholm, Sweden

[73] Assignee: Claes Martin Weibull, Hassleholm, Sweden

[22] Filed: June 4, 1974

[21] Appl. No.: 476,266

[52] U.S. Cl. ..... 34/46; 34/54; 34/77; 34/225

[51] Int. Cl.[2] ..... F26B 21/06

[58] Field of Search ..... 34/26, 28–32, 34/46, 54, 77, 78, 179, 187, 221, 224, 225, 232, 233

[56] References Cited

UNITED STATES PATENTS

| | | | |
|---|---|---|---|
| 842,538 | 1/1907 | Elward | 34/232 |
| 1,711,574 | 5/1929 | Miller | 34/46 |
| 2,799,947 | 7/1957 | Elwess | 34/77 |
| 3,264,118 | 8/1966 | Kilcrease et al. | 34/26 |
| 3,358,856 | 12/1967 | Weibull | 214/17 |
| 3,429,619 | 2/1969 | Weibull | 302/50 |
| 3,826,824 | 3/1958 | Campbell | 34/46 |

*Primary Examiner*—Kenneth W. Sprague
*Assistant Examiner*—Larry I. Schwartz
*Attorney, Agent, or Firm*—Browne, Beveridge, DeGrandi & Kline

[57] ABSTRACT

Storage of grains and other vegetable products in a large-capacity silo having air-tight walls, bottom and roof and air conditioning means, which is arranged to supply air of controlled moisture content and temperature. The silo has double walls defining a space and said air supplying means is connectible either to the storage space of the silo through aeration openings in the silo bottom or to said space between the silo walls.

6 Claims, 1 Drawing Figure

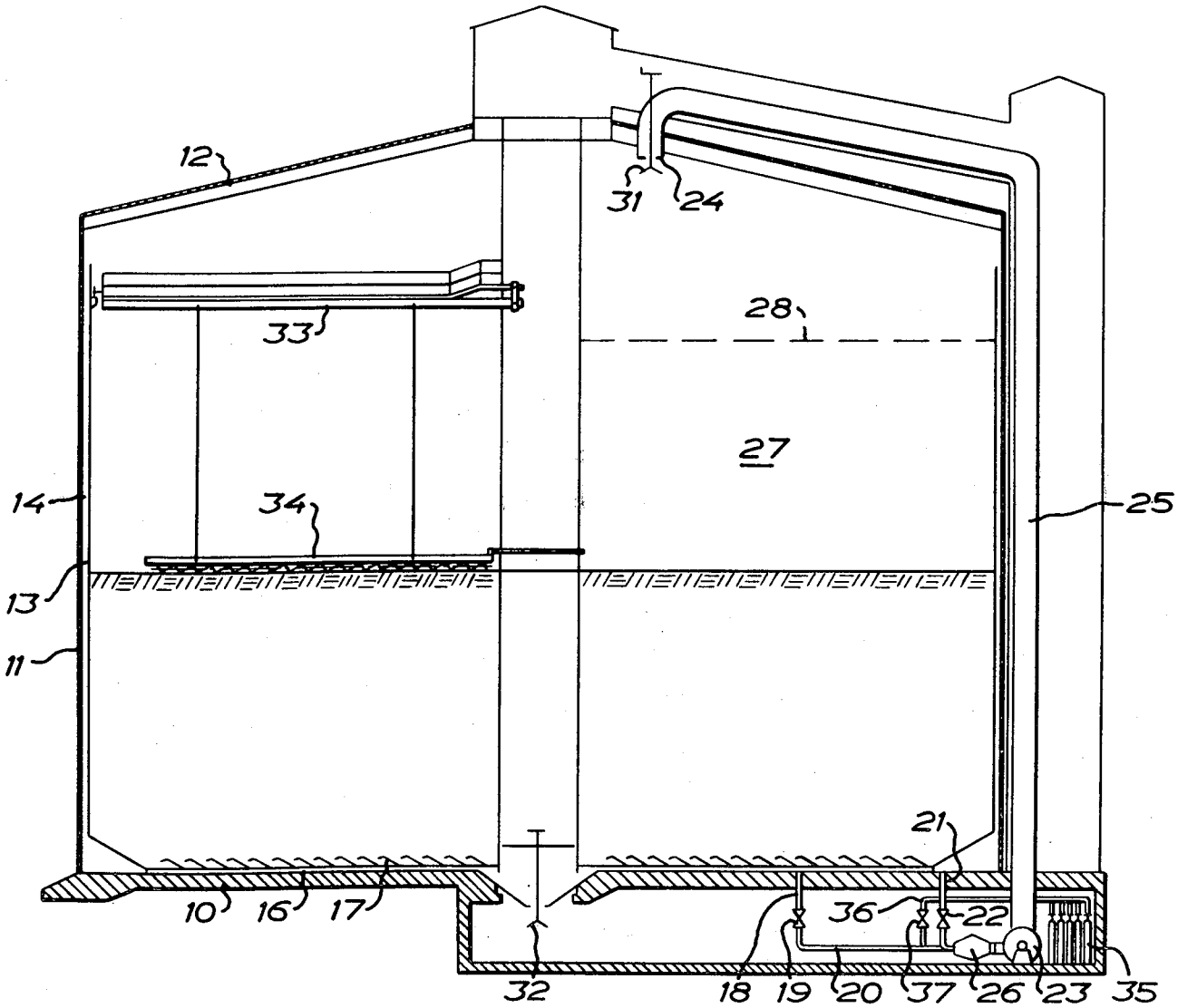
25
35
23
26
22
37
21
36
20
19
18
28
27
24
31
32
17
16
10
33
34
12
14
13
11

APPARATUS FOR STORING GRAINS AND OTHER VEGETABLE PRODUCTS

For the last decades use has generally been made of concrete silos with a great many cells of small diameter and great height for storing grains and other vegetable products. The reason is that it is often desired to keep different grain lots separated so that qualities or sorts are not intermingled, and to permit aeration of the grains by moving the grains from one cell of the silo to another by means of a conveyor. Recently, however, there has arisen the need for silo types suited for the storage of large quantities of uniform goods. For natural reasons problems are encountered when the grains are to be aerated or conditioned for maintaining the quality thereof. It is hardly conceivable to resort to a rearrangement or shifting of the grains as has been done in silos divided into cells, and what is more such rearrangement or shifting is unsuitable also in prior art silos since the grains are subjected to considerable wear with ensuing formation of dust. Moreover, the concrete silos as hitherto used normally are not water-tight and consequently rain-water can penetrate into the silo, altering the moisture conditions therein and even wetting the grains adjoining the walls and roof of the silo.

The object of the present invention is to provide a method and an apparatus for improved and advantageous storage of grains and other vegetable products in large-capacity silos at reasonable cost and without necessitating rearrangement of the stored grains at any time during the time of storage. This is realized according to the invention in that the stored grains after they have been charged into the silo which is made from air-tight material, for instance sheet metal, are maintained in undisturbed state for the entire storage time with periodical or continuous supply of air the moisture and temperature of which is controlled so that suitable climatic conditions are maintained in the silo.

In a preferred embodiment of the invention the supplied air is caused to flow through the stored grains in the silo and/or to sweep along the outer side of the silo. The air supplied to the grains stored in the silo can be admixed with disinfectants.

To realize the method, outlined in the foregoing, for the storage of grains and other vegetable products, use is made according to the invention of a silo having means for charging the silo with the grains to be stored therein, distributing them in and withdrawing them from the silo. According to the invention, the silo is entirely closed except for controllable aeration openings and made from an air-tight material, and an air conditioning unit is arranged to supply to the silo air of controlled moisture content and temperature. The silo preferably has double walls defining a space which extends at least over the major part of the boundary surface of the silo, and the air conditioning unit is connectible either to the storage space of the silo through said aeration openings or to said space between the double silo walls, or both.

These and further details characteristic of the invention will become apparent from the following specification and claims and the accompanying drawing which, in plan view and partly in section, diagrammatically illustrates a preferred embodiment of the invention.

The silo illustrated in the drawing comprises a foundation 10 of concrete which supports an outer shell 11 having a roof 12. In said outer shell 11 there is arranged an inner shell 13 which together with the outer shell 11 defines a space 14 which extends substantially all around the inner shell. The outer and inner shells are made from air-tight material, preferably sheet metal, and are so united as to encirlce in air-tight fashion, except for aeration openings to be described in the following, a storage space 27 for grains. As will appear from the drawing, the inner shell 13 terminates short of the upper end of the outer shell so that the space 14 between the shells opens into a chamber defined by the roof 12 of the outer shell and the upper level 28 of the grains contained in the storage space 27. At the bottom the silo has a double floor which defines a distributing space 16. Aeration openings 17 are formed in the inner floor and the storage space 27 thus is in communication with the distributing space 16 in the floor through said openings 17. Pipelines 18 equipped with a valve 19 and branched off from a main pipeline 20 open into said distributing space 16. Pipelines 21 are also branched off from the main pipeline 20, said pipelines 21 being equipped with a valve 22 and opening into the space 14 between the inner and outer shells of the silo. The main pipeline 20 is connected to the pressure side of a fan 23 while the suction side of the fan is connected with an aeration opening 24 in the silo roof 12 through a conduit 25. An air conditioning unit generally designated 26 and of any suitable prior art construction is connected in the main pipeline 20. The silo comprises means 33, 34 for charging the silo with grains, distributing said grains in and withdrawing them from the silo. Said means do not form any constituent part of the present invention and are not therefore described in detail.

After grains or other vegetable products have been charged into the silo, for example up to the level 28, the silo is hermetically closed. Whenever necessary, the fan 23 and the air conditioning unit 26 are activated to blow in conditioned air into the space 27 through the pipelines 18, the space 16 and the aeration openings 17. The air is thus caused to flow through the grains stored in the space 27 and to escape through the discharge opening 24, returning to the fan 23. In this manner, the correct temperature and moisture content can be maintained by simple means in the space 27. Such conditioning may be effected, for instance immediately after supply of the grains to the space 27, to increase or reduce the moisture content of the grains and subsequently at given periods, whenever required. While conditioning of the space 27 normally takes place at given periods, it may of course be necessary in particularly difficult circumstances continuously to aerate said space. A unit 35 for the admixture of disinfectants, such as fungicides, insecticides etc., can be connected through a conduit 36 to the line between the fan 23 and the pipelines 18, for instance in conjunction with the air conditioning unit 26 so that fungicidal, insecticidal and like treatment of the grains can readily take place whenever required. At such treatment the silo must be hermetically sealed, which is realized in.t.al. by means of a valve 31 for the aeration opening 34, a valve 32 for a discharge opening in the floor etc.

Instead, or as a complement of, the aeration of the grains in the space 27, conditioned air may be caused to flow from the fan 23 and the air conditioning unit 26 along the outer side of the inner shell 13 through the space 14, in which case the valves 19 are shut and the valves 22 are opened. Such aeration can also take place continuously or intermittently, implying the advantage that less air is required.

It will be readily understood from the foregoing description that the present invention provides an extremely simple method and apparatus for maintaining a high quality of the goods stored in a large-capacity silo.

What I claim and desire to secure by Letters Patent is:

1. A large-capacity silo for storing grains and other vegetable products, comprising air-tight outer wall, bottom and roof, means for charging the silo with grains to be stored therein, means for distributing said grains in the silo, means for withdrawing said grains from the silo, an air conditioning unit having an outlet side for supplying to the silo air of controlled moisture content and temperature, aeration means for causing the supplied air to flow through the grains stored in the silo, an inner wall defining with said outer wall a space which extends at least over the major part of the boundary surface of the silo, first means for connecting said air conditioning unit to said space between the silo walls, said aeration means comprising aeration opening means located at the silo bottom and means operable independently of the first means for connecting the outlet side of the air conditioning unit to said aeration opening means.

2. A large-capacity silo as in claim 1, in which means for supplying disinfectants is connected to a line, extending between the air conditioning unit and the silo for admixing disinfectant to such air as is caused to flow through the grains stored in the silo.

3. A large-capacity silo as in claim 1 having an air outlet opening in the silo roof, said air conditioning unit has an air inlet side connected to said air outlet opening.

4. A large-capacity silo as in claim 3 wherein said inner wall is formed of an air-tight material, and said space between said walls is in communication with an upper interior area of said silo adjacent to said roof, whereby air introduced into said space is released above the level of grain in the silo for return to the air conditioning unit via the air outlet opening.

5. A large-capacity silo as in claim 3 having a valve means for closing said air outlet opening.

6. A large-capacity silo as in claim 4, in which means for supplying disinfectants is connected to a line, extending between the air conditioning unit and the silo for admixing disinfectant to such air as is caused to flow through the grains stored in the silo.

* * * * *